US007052286B2

(12) United States Patent
Zhang

(10) Patent No.: US 7,052,286 B2
(45) Date of Patent: May 30, 2006

(54) ELECTRICAL CONNECTOR WITH COVER

(75) Inventor: Chi Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/917,650

(22) Filed: Aug. 13, 2004

(65) Prior Publication Data

US 2005/0037642 A1 Feb. 17, 2005

(30) Foreign Application Priority Data

Aug. 13, 2003 (TW) ..... 92214635 U

(51) Int. Cl.
*H01R 12/00* (2006.01)
*H01R 13/648* (2006.01)

(52) U.S. Cl. ..... 439/74; 439/108; 439/607

(58) Field of Classification Search ..... 439/61, 439/135, 74, 65, 159, 108
See application file for complete search history.

(56) References Cited

U.S. PATENT DOCUMENTS

| | | | | |
|---|---|---|---|---|
| 5,383,797 | A | 1/1995 | Seong et al. | 439/569 |
| 5,915,976 | A | 6/1999 | McHugh | 439/74 |
| 6,015,305 | A * | 1/2000 | McHugh et al. | 439/135 |
| 6,095,824 | A * | 8/2000 | McHugh | 439/74 |
| 6,464,515 | B1 * | 10/2002 | Wu | 439/108 |
| 6,558,195 | B1 * | 5/2003 | Kusuhara | 439/607 |
| 6,942,509 | B1 * | 9/2005 | Sasame et al. | 439/181 |
| 2001/0041468 | A1 * | 11/2001 | Zweigle et al. | 439/135 |

* cited by examiner

*Primary Examiner*—Michael C. Zarroli
(74) *Attorney, Agent, or Firm*—Wei Te Chung

(57) ABSTRACT

An electrical connector (1) includes an elongate insulative housing (10), a number of contacts (20), a shell (30), a cover (40) and a pair of soldering pads (50). The insulative housing includes a mating surface (11), two side walls (12) and a channel (13) between the side walls. The contacts are received in the insulative housing and each comprises an engaging portion (21) and a soldering portion (22). The shell is assembled to outer surfaces of the side walls. The cover is adhered to the mating surface for obstructing the shell from moving upwardly.

10 Claims, 8 Drawing Sheets

ELECTRICAL CONNECTOR WITH COVER

BACKGROUND OF THE INVENTION

1. Field of the Invention

The present invention relates to an electrical connector, and more particularly to an electrical connector having a shell securely retained thereon.

2. Description of the Related Art

Electrical connectors are used in a variety of applications. One type of connector is commonly known as a board-to-board connector for interconnecting two circuit boards. A board-to-board connector typically includes interengageable male and female connectors. U.S. Pat. No. 5,915,976 discloses such a plug connector comprising an insulative housing, a plurality of contacts received in the insulative housing, and a pair of grounding plates positioned on two sides of the housing of the plug connector wherein a plurality of grounding pins of each grounding plates are selectively connected to some of the contacts of the plug connector, and a corresponding number of engagement arms are positioned opposite to such grounding pins, respectively. In such a way, the housing of the plug connector includes a number of pairs of protrusions positioned on an exterior surface of each side wall for mating with corresponding retention arms of the grounding plates. The structure of the housing will occupy too much space on a printed circuit board (PCB). Furthermore, assembling of the engagement arms of the grounding plates is inconvenient.

Hence, an improved electrical connector is required to overcome the disadvantages of the prior art.

SUMMARY OF THE INVENTION

A major object of the present invention is to provide a method, which secures a shell in two side walls of an insulative housing for reducing occupied space of a printed circuit board (PCB) and providing a simplified assembling processes.

In order to achieve the object set forth, an electrical connector comprises insulative housing, a plurality of contacts, a shell, a cover and a pair of soldering pads. The insulative housing includes a mating surface, two side walls and a channel between the side walls. Each side wall defines a plurality of elongate cavities and a plurality of positioning passageways. The contacts are received in the insulative housing and each comprises an engaging portion and a soldering portion. The shell is assembled to outer surfaces of the side walls. The cover is adhered to the mating surface for obstructing the shell moving upwardly.

Other objects, advantages and novel features of the invention will become more apparent from the following detailed description when taken in conjunction with the accompanying drawings.

DETAILED DESCRIPTION OF THE INVENTION

Figure 1:
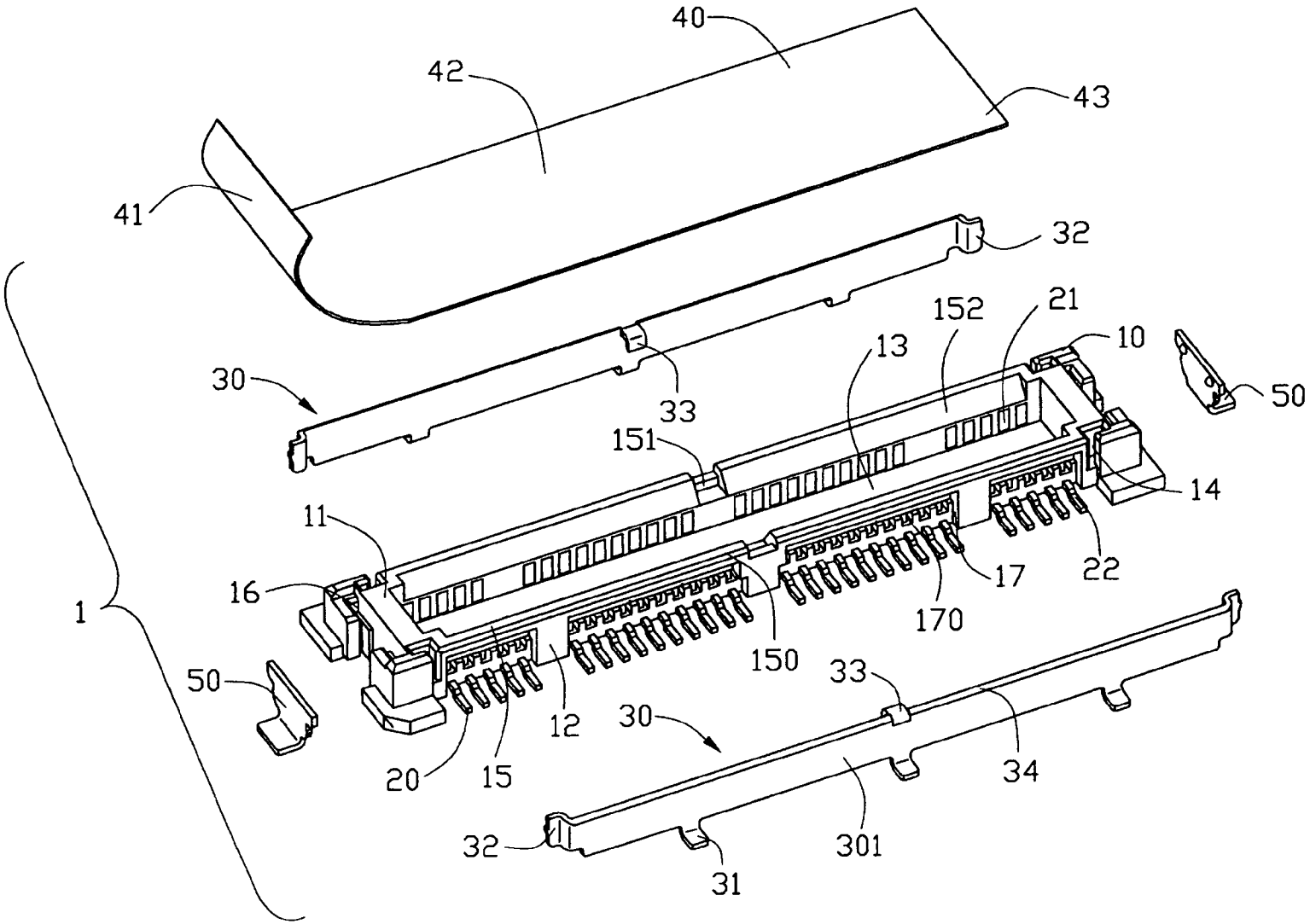
FIG. 1 is an exploded, perspective view of an electrical connector in accordance with the present invention.

Referring to FIG. 1, an electrical connector 1 comprises an insulative housing 10, a plurality of contacts 20, a shell 30, a cover 40, and a pair of soldering pads 50.

Figure 2:
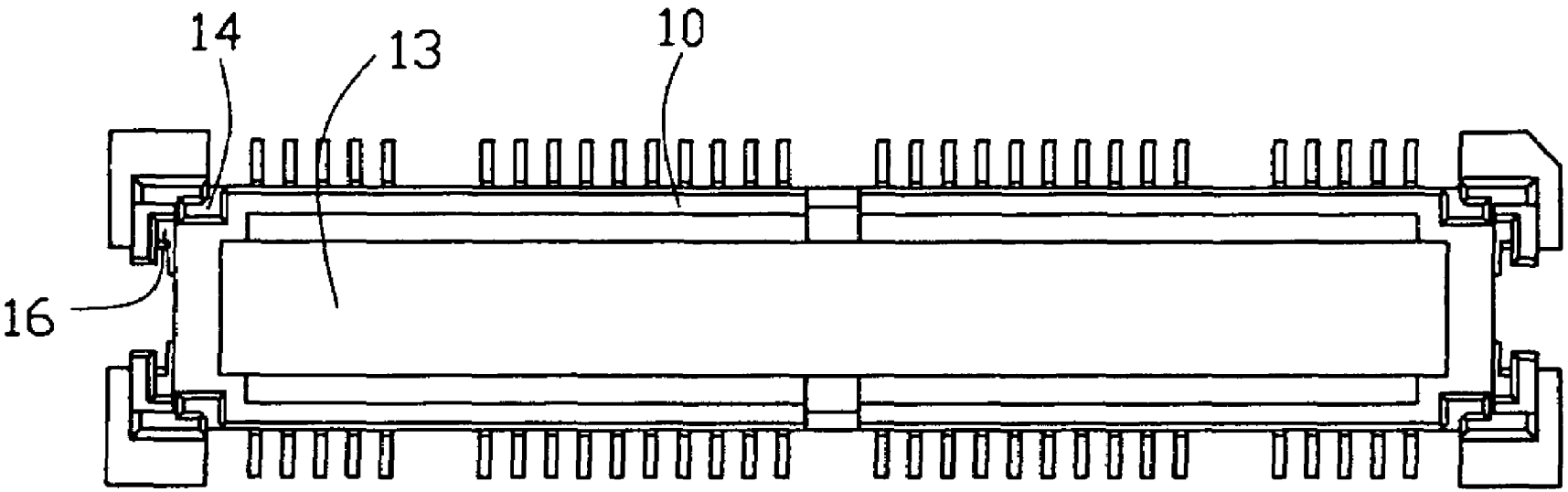
FIG. 2 is an assembled, top view of the electrical connector of FIG. 1.
Figure 8:
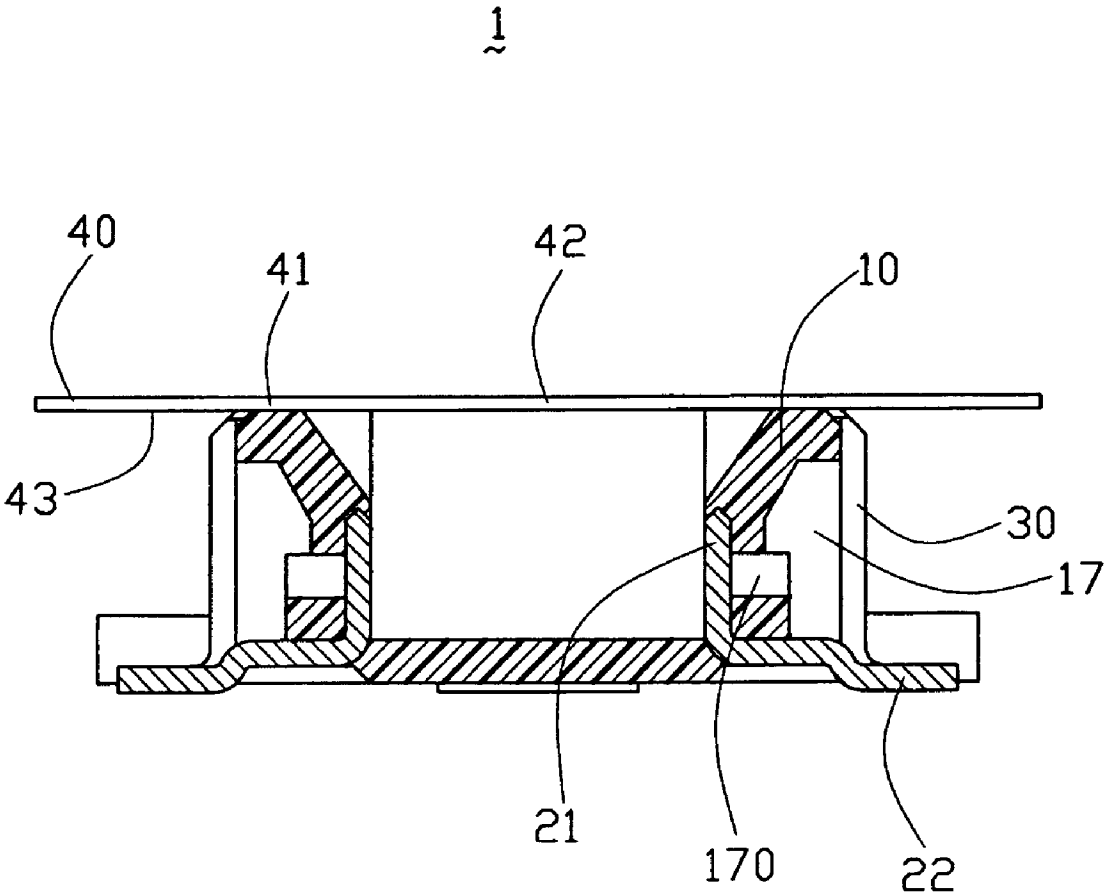
FIG. 8 is a cross-sectional view taken along line VIII—VIII of FIG. 7.

The insulative housing 10 is elongate and comprises a mating face 11 and opposite side walls 12 extending downwardly from the mating face 11. The mating face 11 defines a slot 13 at a middle portion thereof. Each side wall 12 defines a ramp 152 at an upper portion of an inner surface 15 thereof for guiding a complementary connector (not shown) inserting into the slot 13. A top end 150 of the side wall 12 defines a recess 151 at a middle portion thereof. Referring to FIGS. 1 and 8, each side wall defines a plurality of elongate cavities 17 at an outer surface. A plurality of positioning passageways 170 corresponding to the contact 20 is arranged in the cavities 17. Referring to FIGS. 1 and 2, connecting areas (not labeled) between the side walls 12 and lateral walls (not labeled) of the insulative housing 10 define four slits 14. An opening 16 is defined at each lateral wall and is positioned between every two slits 14 for receiving the soldering 50.

The contacts 20 are securely retained in the insulative housing 10 by insert-molding. Each contact 20 comprises an engaging portion 21 received in an inner surface 15 of the side wall 12, and a soldering portion 22 mounted on a printed circuit board (PCB).

The shell 30 is assembled to outer surfaces of the side walls 12. The shell 30 is divided into two parts. The two parts are symmetrical. Each pan comprises a body portion 301, a bending portion 33 at a middle portion of a top end 34, a pair of securing portions 32 at two lateral walls, and a plurality of tail portions 31 for being soldered to the PCB.

Figure 3:
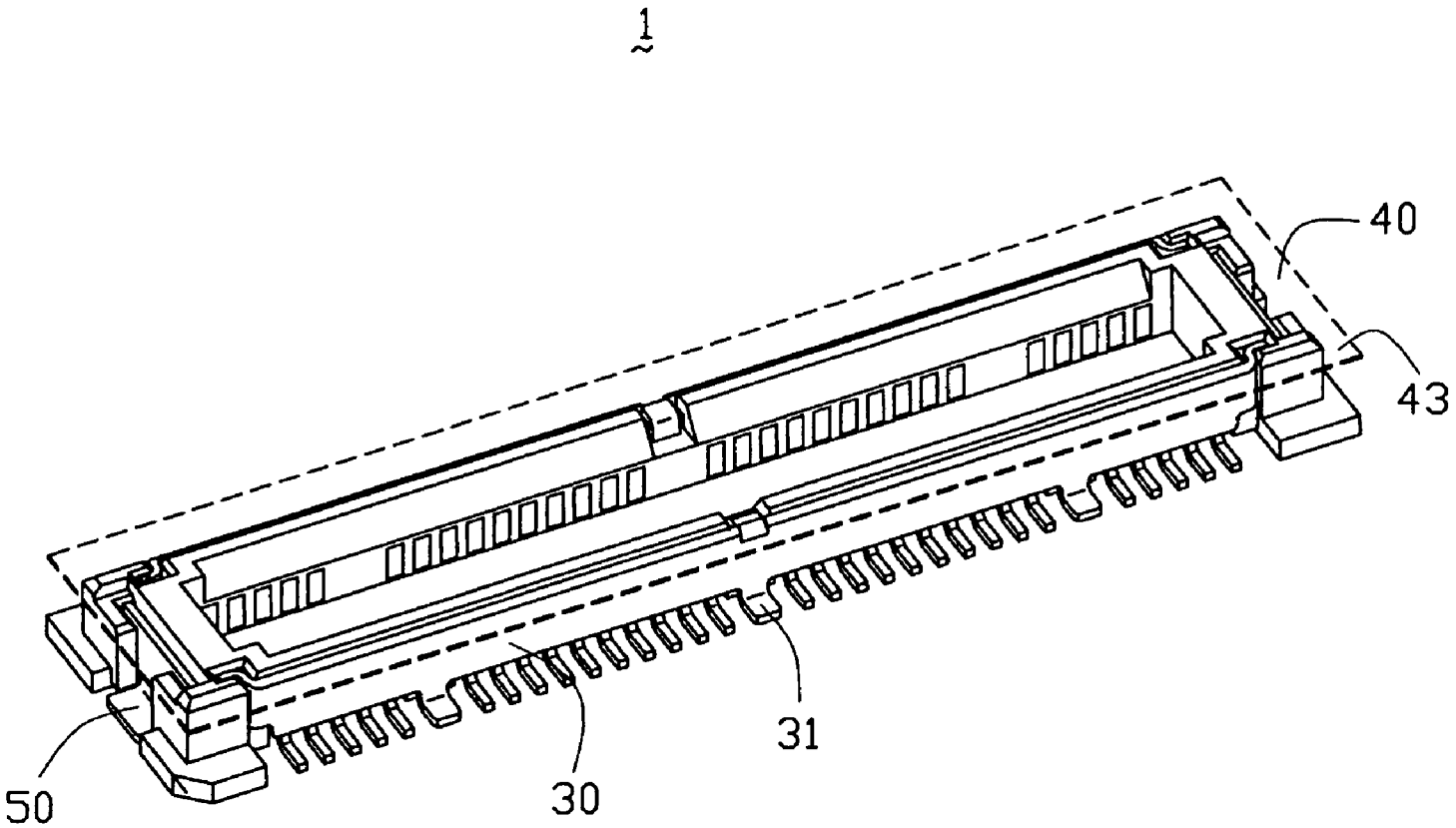
FIG. 3 is an assembled, perspective view of the electrical connector of FIG. 1.
Figure 4:
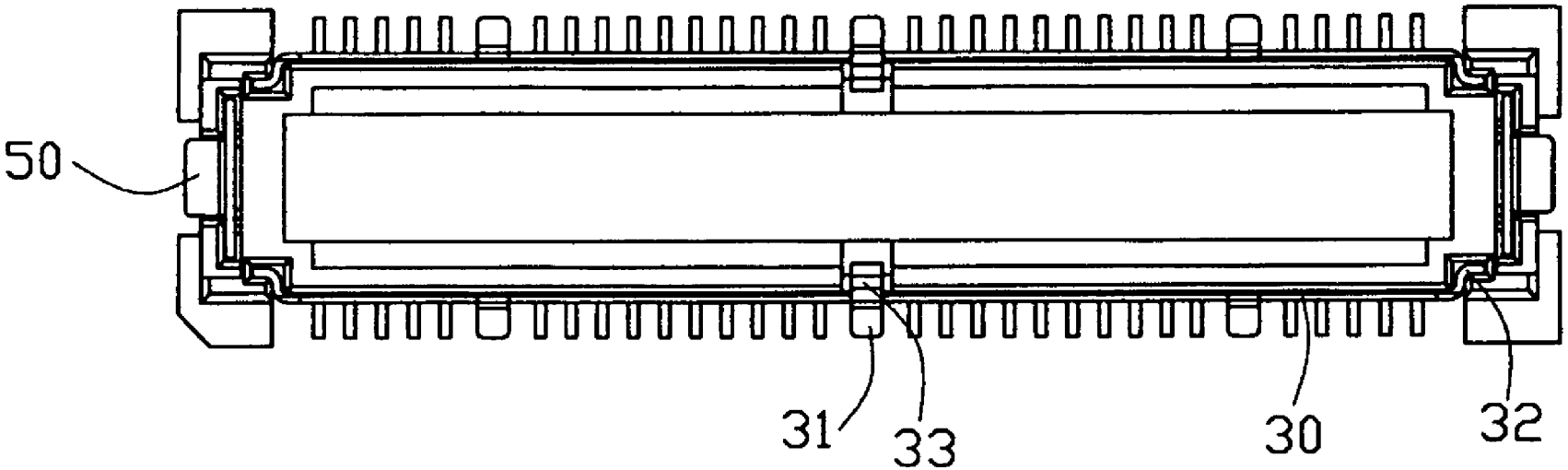
FIG. 4 is an assembled, bottom view of the electrical connector of FIG. 1.
Figure 5:
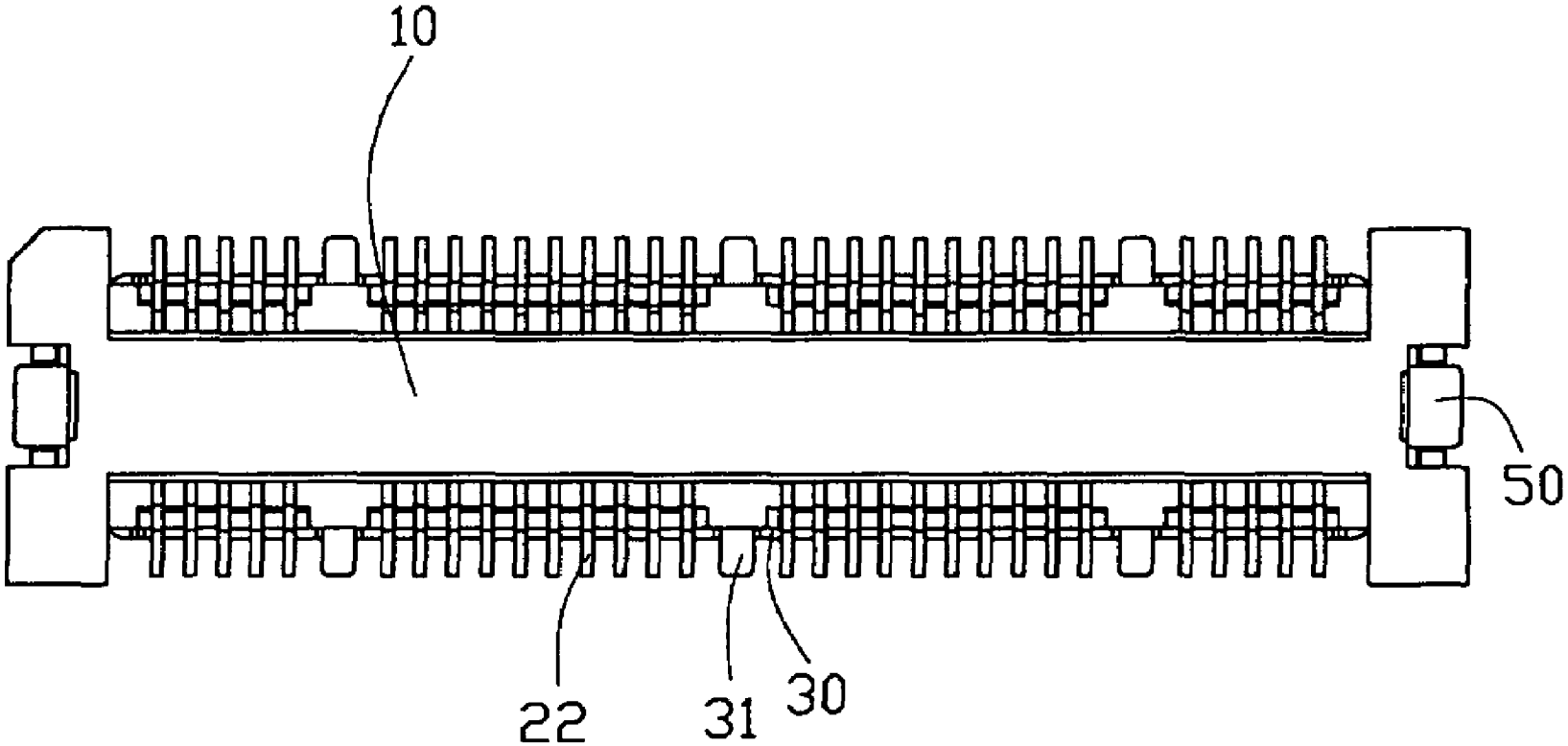
FIG. 5 is a partly assembled, bottom view of the electrical connector of FIG. 1.
Figure 6:
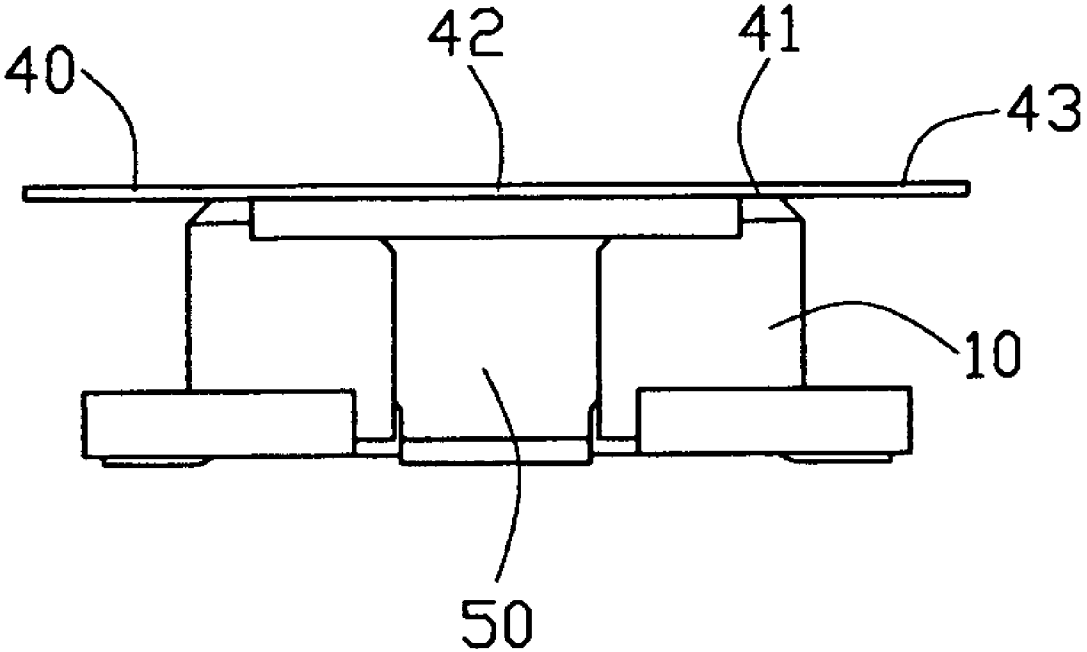
FIG. 6 is an assembled, side view of the electrical connector of FIG. 1.
Figure 7:
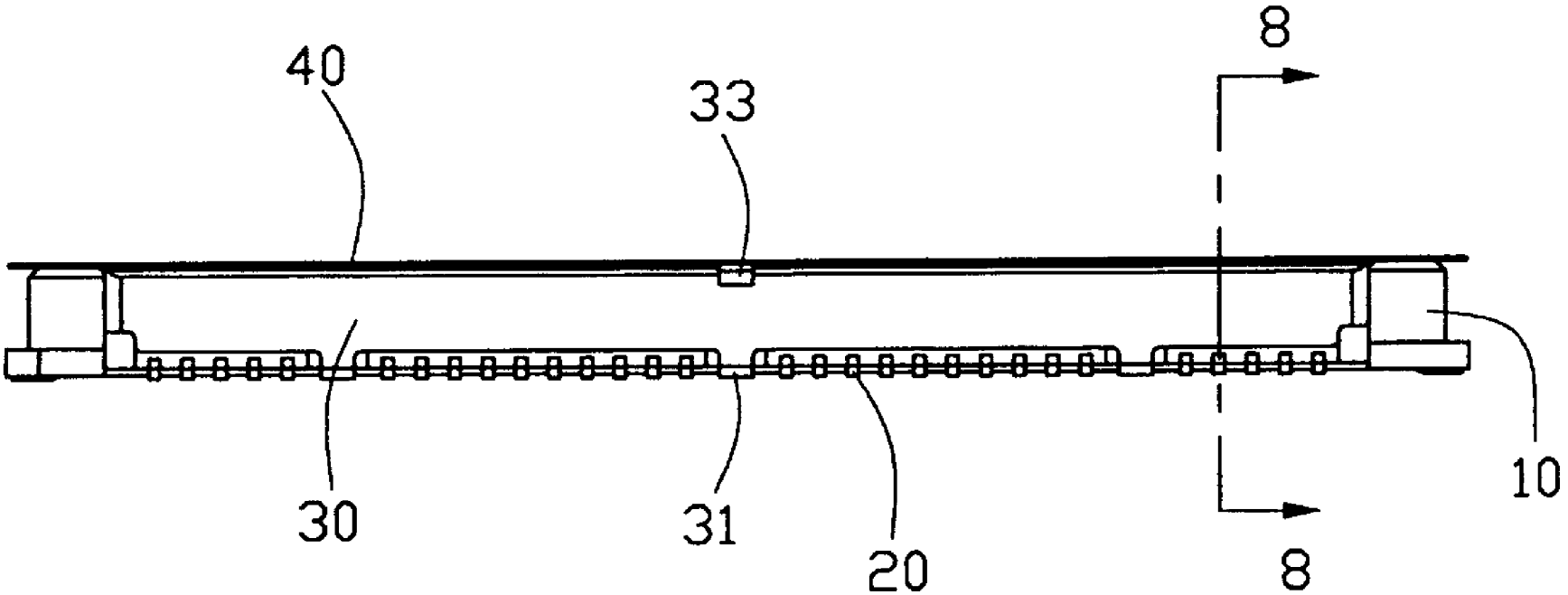
FIG. 7 is an assembled, front view of the electrical connector of FIG. 1.

Refer to FIGS. 1 and 3. The cover 40 is made from dielectric material and comprises an adhesive surface 41 adhering to the mating surface 11 for preventing the shell 30 from moving upwardly, and an upper surface 42, and an edge portion 43. After mounting the connector 1 on the PCB, the cover 40 can be torn off from the insulative housing 40 via the edge portion 43.

Referring to FIGS. 3 to 8, in assembly, the contacts 20 are first retained in the insulative housing 20 by insert-molding. The shell 30 is assembled to the outer surfaces of the side walls 12 of the insulative housing 10. The bending portion 33 and the securing portion 32 respectively mating with the recesses 151 and the slits 14. The soldering pads 50 are installed in the opening 16 of the insulative housing 10 along an up-to-down direction. The adherent surface 41 of the cover 40 is adhered to the mating surface 11 of the insulative housing 10.

The cover 40 of the present invention can provide a function of fixing position to the shell 30. When the shell moves upwardly, the cover 40 can obstruct a movement of the shell 30. Therefore, the structure of the side walls 12 of the insulative housing 10 can be simplified. At the same time, the occupied space of the PCB also can be reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an elongate insulative housing having a mating surface, two side walls, two lateral walls adjoining said side walls and a channel surrounded by the side walls and the lateral walls;

a plurality of contacts received in the insulative housing and each comprising an engaging portion and a soldering portion;

a shell assembled to outer surfaces of the side walls and having a pair of securing portions;

a cover adhered to the mating surface for obstructing the shell from moving upwardly; and wherein the insulative housing defines a plurality of slits formed at connecting areas of the side walls and the lateral walls so as to mate with the corresponding securing portions of the shell.

2. The electrical connector as claimed in claim 1, wherein the cover is made from dielectric material.

3. The electrical connector as claimed in claim 1, wherein the cover comprises an adherent surface, an upper portion, and an edge portion.

4. The electrical connector as claimed in claim 3, wherein the adherent surface of the cover is adhesive.

5. The electrical connector as claimed in claim 1, wherein the shell has a plurality of tail portions soldered to a printed circuit board.

6. The electrical connector as claimed in claim 1, wherein each lateral wall of the insulative housing defines an openings positioned between every two slits.

7. The electrical connector as claimed in claim 1, wherein the side walls define ramps at upper portions of inner surfaces thereof.

8. The electrical connector as claimed in claim 6, further comprising a pair of soldering pads partially retained in corresponding openings of the insulative housing.

9. An electrical connector assembly comprising:

an insulative housing defining an upper opening and at least one side wall beside said opening;

a plurality of contacts disposed in the housing;

a metallic shielding plate downwardly attached to an exterior face of said side wall;

a removable cap attached to the housing to not only cover at least a portion of the opening for a pick-and-play suction operation during surface-mounting the housing to a printed circuit board, but also preventing said shielding plate from upward moving; wherein the shielding plate has a bending portion extending from a top edge thereof along a top surface of said side wall and a pair of securing portions formed at lateral edges thereof, and the shielding plate is completely attached on the housing until the bending portion and the securing portions are downwardly fixed in the housing.

10. The assembly as claimed in claim 9, wherein said cap is removed from the housing after the housing is surface-mounted to the printed circuit board under a condition that a bottom portion of the shielding plate is also fixed to said printed circuit board.

* * * * *